US005931480A

United States Patent [19]

Schroeder

[11] Patent Number: 5,931,480

[45] Date of Patent: Aug. 3, 1999

[54] FOOTGEAR SUSPENSION DEVICE

[76] Inventor: Scott T. Schroeder, 6083 Cherrywood Cir., Littleton, Colo. 80121

[21] Appl. No.: 08/742,552

[22] Filed: Oct. 28, 1996

[51] Int. Cl.[6] ..... A63C 17/00

[52] U.S. Cl. ..... 280/11.28; 280/11.2

[58] Field of Search ..... 280/11.2, 11.22, 280/11.27, 11.28, 11.14, 11.31, 842, 825, 811; 301/5.3

[56] References Cited

U.S. PATENT DOCUMENTS

| | | | |
|---|---|---|---|
| 44,176 | 9/1864 | Forsyth, Jr. | 280/11.14 |
| 1,597,792 | 8/1926 | Hoff et al. | 280/11.14 |
| 3,203,706 | 8/1965 | Boyden | 280/11.28 |
| 3,951,422 | 4/1976 | Hornsby | 280/11.28 |
| 4,061,348 | 12/1977 | Carter | 280/11.14 |
| 4,310,168 | 1/1982 | Macaluso | 280/11.24 |
| 4,351,538 | 9/1982 | Berta | 280/11.28 |
| 4,403,784 | 9/1983 | Gray | 280/11.28 |
| 4,700,958 | 10/1987 | Volpato | 280/842 |
| 4,943,075 | 7/1990 | Gates | 280/8.42 |
| 5,127,672 | 7/1992 | Horibata | 280/842 |
| 5,251,934 | 10/1993 | Gates | 280/842 |
| 5,271,633 | 12/1993 | Hill, Jr. | 280/11.22 |
| 5,332,246 | 7/1994 | Buell | 280/284 |
| 5,342,071 | 8/1994 | Soo | 280/11.22 |
| 5,346,231 | 9/1994 | Ho | 280/11.2 |
| 5,348,321 | 9/1994 | Sbrilli | 280/11.22 |
| 5,411,277 | 5/1995 | Pratt | 280/11.22 |
| 5,411,278 | 5/1995 | Wittman | 280/11.22 |
| 5,441,286 | 8/1995 | Pozzobon | 280/11.27 |
| 5,503,413 | 4/1996 | Belogour | 280/11.22 |
| 5,566,958 | 10/1996 | Sinelnikov et al. | 280/11.22 |
| 5,582,418 | 12/1996 | Closser | 280/11.28 |
| 5,630,624 | 5/1997 | Goodman | 280/11.22 |
| 5,630,891 | 5/1997 | Peterson et al. | 280/11.22 |

FOREIGN PATENT DOCUMENTS

| | | | |
|---|---|---|---|
| 559179 | 9/1993 | European Pat. Off. | 280/11.22 |
| 233545 | 4/1911 | Germany | 280/11.22 |
| 2308173 | 8/1974 | Germany | 301/5.3 |
| 993964 | 2/1983 | U.S.S.R. | 280/842 |
| 93/12846 | 7/1993 | WIPO | 280/11.22 |
| 93/12847 | 7/1993 | WIPO | 280/11.22 |

*Primary Examiner*—J J Swann
*Assistant Examiner*—Frank Vanaman
*Attorney, Agent, or Firm*—Steve Kahm

[57] ABSTRACT

A footgear suspension device for a skate utilizing wheels or another surface contacting means such as skis or shoe soles mounted on swingarms. Movable swingarms may range in size, shape, composition, or length. The footgear suspension device chassis may consist of pivots, swingarms, linkage pieces and energy absorbing devices. Pivots may allow swingarms to rotate or swing. Energy absorbing devices may be hydraulic or spring loaded or other means and may dampen swingarm motion. Some embodiments of the footgear suspension device may contain a surface contacting means integral with the footgear suspension device. Other embodiments may contain a footgear suspension device built directly into the user's footwear, and some embodiments of the footgear suspension device may utilize adjustable and releasable boot bindings. The footgear suspension device may be an integral piece of a ski or skate or bindings and may also integrally contain energy absorbing devices. The footgear suspension device may be used where a human being may require or benefit from the mechanical advantage provided by the footgear suspension device. The footgear suspension device offers advantages in many places where all of today's existing skates and similar foot gear are lacking. For instance, stability, control, traction, and mechanical advantage may be provided by the footgear suspension device. An object of this invention is to provide a well balanced responsive foot suspension system that allows the body it carries to maneuver more freely, gracefully, powerfully, aerodynamically, quickly, and perfectly over many terrains and surfaces than is possible without the mechanical advantage provided by the footgear suspension device.

13 Claims, 2 Drawing Sheets

FOOTGEAR SUSPENSION DEVICE

BACKGROUND OF THE INVENTION

1. Field of the Invention

This invention relates to a suspension system for attatching a user's foot to a device which contacts the ground and more particularly a footgear suspension system having pivotable swingarms and an energy absorbing means.

2. Description of the Related Art

Roller-skating has been an enjoyable pastime for many generations of human beings and originally, the roller-skates used were of the so-called "quad" type with each skate having two wheels in the front and two wheels in the rear.

The next great development in skate technology came when linear skates were introduced. Linear skates increased skater speeds and maneuverability of skates. Linear or in-line skates have at least three wheels and may utilize more, some say as a generality the more wheels the smoother the ride.

In-line roller-skates have become very popular among ice skaters as a training tool as the same bodily movements arc utilized by both ice skaters and in-line skaters. In fact it has been rumored that in the year 2000 in-line skating will be an Olympic sport.

The first in-line skates appeared in the patent office as early as 1876 in U.S. Pat. No. 7,345 of C. W. Saladee which disclosed a complicated two wheel device which was quite heavy and difficult to manufacture.

A three wheeled skate utilizing a track which surrounds the wheels so as to avoid damaging wooden floors was introduced by O. G. Reiske U.S. Pat. No. 2,412,290 in 1946. The intermediate wheel was vertically adjustable to allow for forward and rearward rocking action.

Perhaps the most utilized in-line skate design is the Ware frame, U.S. Pat. No. 3,287,023 to G. K. Ware in 1966. This frame incorporates a metal frame with various axle apertures which allow for wheel height variance in many combinations. This skate utilized a tough resilient rubber wheel with press-in bearings.

In 1993, Patrick G. Gates in U.S. Pat. No. 5,251,934 disclosed an in-line skate ski of the two wheel variety which consisted of a single body rigid skate chassis upon which a brake and somewhat elaborate foot strap were attached. The entire system was devoid of any suspension except for pneumatic tires which were presumably inflated through a valve along the edge of the tire. The whole system utilized components that were "readily available" and not necessarily specialized. The skate chassis rested directly upon the wheel axles and thus reduced the lever arm of the foot plane to the wheel to approximately a minimum. The clearance of the entire apparatus was limited to approximately half of the wheel which was indicated to be about three inches.

U.S. Pat. No. 5,503,413 issued Apr. 2, 1996 to Pavel Belogour of Boston, Mass. disclosed a skate with a spring and a pivot but the skate contained no means for changing surface contacting means and no way of changing force directions and moving forces away from the user. In fact, the forces that travel through the rear spring of Pavel's "in-line roller skates with suspension" are pointed directly at the user. Also Pavel's invention only relates to an "in-line roller skate" not a footgear suspension device that may mount to or be integral with many surface contacting means, nor does the "in-line roller skate with suspension" offer the possibilities of adjustable releasable bindings. Pavel's "in-line roller skates with suspension" also comprise "a wheel frame, with two vertical side members and a plurality of wheels connected between the side members, pivotally connected to the front toe plate." The "in-line roller skates with suspension" disclosed by Pavel contain a front toe plate integral to their function where the footgear suspension device does not have a front toe plate. The "in-line roller skates with suspension" also use conventional in-line skate technology and lack significant stability, traction, control, and any effective mechanical suspension advantage. The "in-line roller skates with suspension" do not account for issues such as ground clearance, vectoral force transfer, energy absorbing device monitoring, and suspension travel. The "in-line roller skates with suspension" also offer no possibilities for integrating pieces such as chassis, footwear, energy absorbing devices, swingarms, bindings, surface contacting means.

Other tandem roller-skates with various wheel structures and skate chassis are shown in U.S. Pat. No. 4,492,385 to Olson; U.S. Pat. No. 3,880,441 to Silver; U.S. Pat. No. 3,900,203 to Kukulowicz; U.S. Pat. No. 3,963,252 to Carlson; U.S. Pat. No. 4,618,158 to Liberkowski; U.S. Pat. No. 5,411,277 to Pratt; U.S. Pat. No. 5,303,940 to Brandner; U.S. Pat. No. 5,346,231 to Ho; U.S. Pat. No. 5,411,278 to Wittman; U.S. Pat. No. 5,342,071 to Soo; U.S. Pat No. 4,310,168 to Macaluso; U.S. Pat. No. 3,951,422 to Hornsby; U.S. Pat. No. 5,385,356 to Conte; U.S. Pat. No. 5,441,286 to Pozzobon; U.S. Pat. No. 5,190,301 to Malewicz; U.S. Pat. No. 5,348,321 to Sbrilli; U.S. Pat. No. 5,135,244 to Allison; at least three U.S. Patents concerning suspension are U.S. Pat. No. 5,462,302; U.S. Pat. No. 4,403,784; and U.S. Pat. No. 5,332,246.

The prior art lacks stability, control, and traction. The prior art also lacks suspension with mechanical advantage. It was in an effort to provide a functional design permitting greater traction, suspension and suspension travel, and mechanical advantage, in order to create higher speeds for racers, better and more advanced performance for recreational users, and a softer foot to surface contact to help protect human joint surfaces, bones, and tissues. The footgear suspension device offers advantages in many places where all of today's existing skates and similar foot gear are lacking. It was in an effort to provide these advantages that the present invention was conceived.

SUMMARY OF THE INVENTION

The invention extends the footprint of the foot of the user by having swingarms extending in front of and behind the user's foot. The swingarms have energy absorbing means to reduce the impact of uneven terrain on the user and reduce the up and down motion of the user. The combination of the greater footprint and shock absorbing offers greater balance and control to the user when the footgear suspension system is attached to a ground contacting device such as rollerskates, iceskates, snow skis, water skis, and other devices. The energy absorbing portion also increases the speed of the user by reducing up and down motion.

OBJECTS OF THE INVENTION

It is an object of the invention to achieve higher speeds in sporting activities involving the use of footgear.

It is a further object of the invention to reduce injuries of the users due to shocks and bumps induced by jumping activities.

It is still a further object of the invention to increase the stability of the user.

It is also an object of the invention to allow the user to pass over rough terrain.

Another object of the invention is to allow the user to jump higher.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
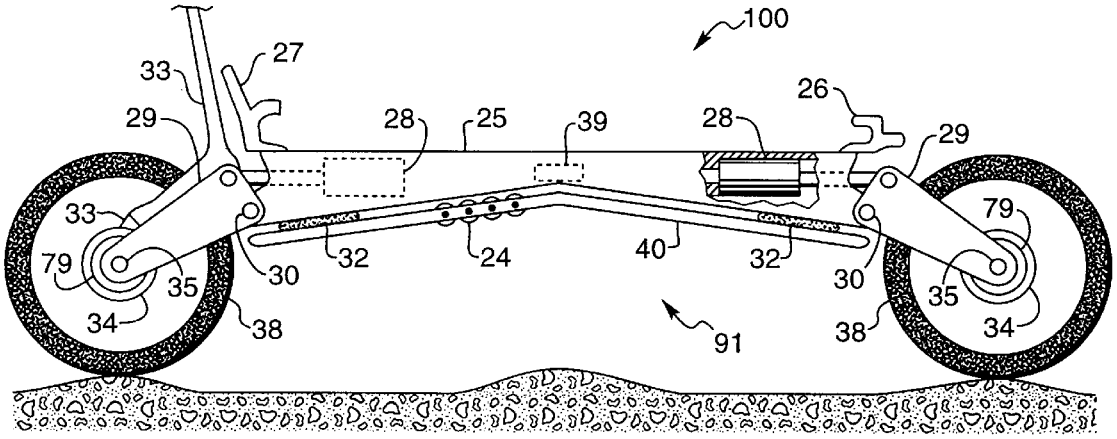
FIG. 1 is a side view of the footgear suspension device having wheels.

FIG. 1 shows a side view of the footgear suspension device 100 having a chassis 25 for supporting the foot of the user. In this embodiment the user would be wearing a boot (not shown) which is attached to the footgear suspension device 100 by a toe binding 26 and a heel binding 27 which are attached to the chassis 25.

Swing arms 29 are attached to the front and rear of the chassis 25 by pivots 30 to allow the swingarms 29 to rotate relative to the chassis 25.

A surface contacting means for engaging the ground, snow, ice, or water is attached to the swingarms 29. The surface contacting means may be, wheels 38 as shown in FIGS. 1 and 2, skis 78 as shown in FIG. 3, or ice skate blades 90 as shown in FIG. 4, or any other ground, water, or snow contacting means.

Wheels 38 have axles 35 with bearings 79. In FIGS. 1 and 2 rear wheels 38 have hubs 34 and brakes 33, which may be activatable by the user to allow for slowing and stopping the wheel.

Means for energy damping 28 such as coil springs, elastomers, compression or friction washers, compressed air springs, adjustable air oil dampers or combinations of springs, elastomers and dampers are attached from the swingarm 29 to the chassis 25 to absorb energy as the swingarms 29 move relative to the chassis 25 which supports the user.

Figure 2:
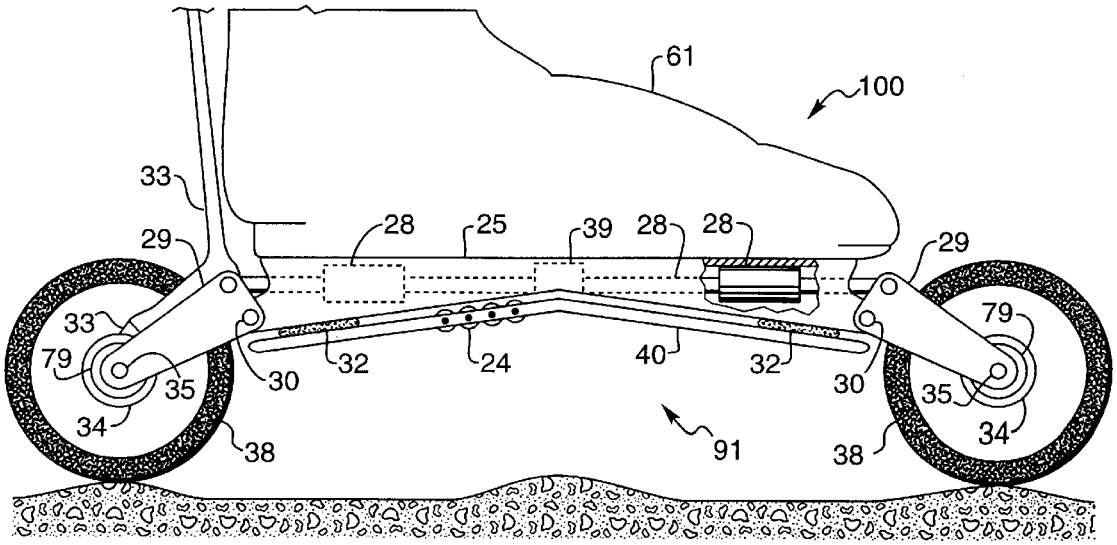
FIG. 2 is a side view of the footgear suspension device with an integral boot.
Figure 3:
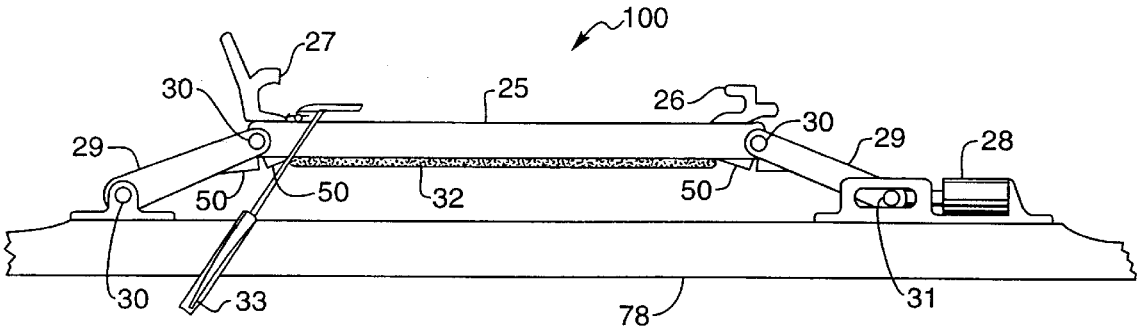
FIG. 3 is a side view of the footgear suspension device mounted on a ski.
Figure 4:
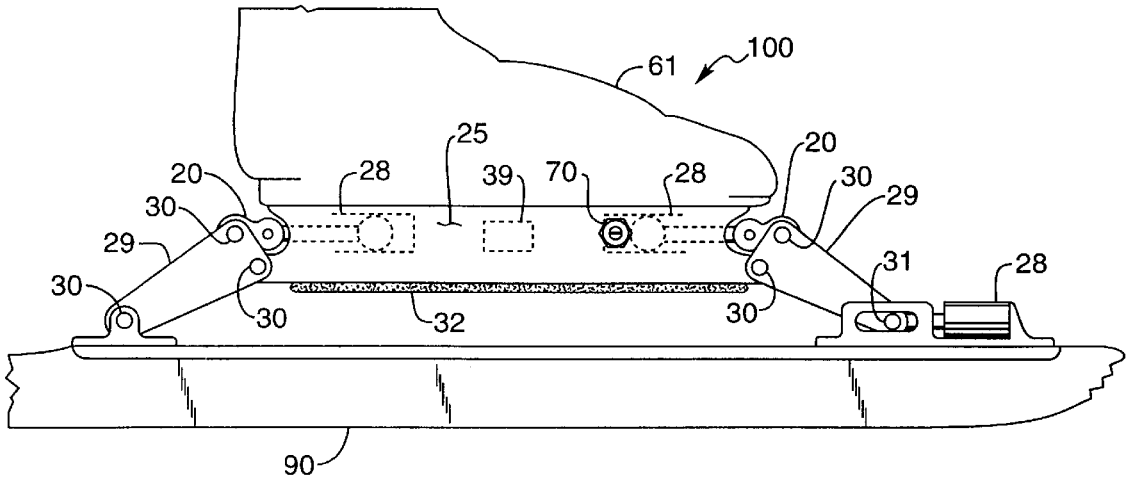
FIG. 4 is a side view of the footgear suspension device having an ice skate blade with an integral boot.

The energy damping means 28 may be attached to the chassis 25 as shown in FIGS. 1, 3, and 4 or integrated into the chassis as shown in FIGS. 2 and 4.

In an alternate embodiment the shock absorbing means may be connected directly from the front swingarm 29 to the rear swingarm 29, such as in FIG. 2 where the energy absorbing device 28 connection goes through the chassis 25. Or the chassis 25 may have a plug 39 and independent energy absorbing devices 28 connecting the chassis 25 to the front and rear swingarms 29.

Curved, angled, straight or bent swing arms 29 connect to the chassis 25. A V-shape chassis 25 may be used to maximize ground clearance and allow for manuevering over obstacles.

The chassis 25 may also have a skid plate 40 attached underneath the chassis 25 for manuevering over obstacles and to protect the chassis 25. Elastomers 32 placed between and connecting the chassis 25 to the skid plate 40 helps absorb shocks and also protects chassis 25. The chassis 25 may have shock absorbing rollers 24 made of a resilient elastomer placed underneath the chassis 25 so the chassis 25 may roll over obstacles rather than skid over obstacles.

In FIGS. 1 and 3 the boot (not shown) is secured to the chassis 25 by toe 26 and heel 27 bindings. This provides the advantages of safety since the bindings may be set to break away from the chassis 25 at different forces saving the user from broken legs and other injuries. The use of bindings in conjunction with the footgear suspension device also allows the user to remove the device and walk in boots without the device.

In FIGS. 2 and 4 a boot 61 is integral with the chassis 25 securely connecting the chassis 25 to the boot. The advantage is the footgear suspension device 100 will not come off because it is securely fastened and the device weighs less without bindings.

FIG. 3 shows the footgear suspension device 100 on a ski 78, pivoted at a fixed point 30 and a sliding point 31 because the footgear suspension device 100 can be configured in such a way that it lengthens as it absorbs shocks and bumps. FIG. 3 also shows a thin elastomer 32 underneath the footgear suspension device 100 to absorb the shock if the device bottoms out. Brakes 33 are also shown, and angle stoppers 50 are used to control the swingarms 29 range of motion.

FIG. 4 shows energy absorbing devices 28 with pistons of various shapes to allow forces to be made linear as they pass through the energy absorbing device 28. FIG. 4 also shows a valve 70 which allows the energy absorbing device 28 to be compressed to variable pressures. FIG. 4 shows swingarms 29 that move in conjunction with linkage swingarms 20 so that forces passing through energy absorbing devices 28 may be pointed away from the user. The exact direction forces travel through the footgear suspension device 100 may be finely controlled by swingarm 29 and linkage swingarm 20 shape, size, and pivot 30 location.

Another feature of the footgear suspension device 100 is the arched underside 91 of the chassis 25 in some embodiments. This feature mimics the shape of the human foot and allows the user to stand directly over the center of the footgear suspension device 100 while standing on a point or rail. This arched underside 91 of the chassis 25 in certain embodiments may be lined with shock absorbing rollers 24 or said hard resistant skid plate 40 to protect the footgear suspension device 100. The entire footgear suspension device 100 may be thought of as a natural extension of the human foot with a mechanical advantage and may be designed and fabricated as such.

Energy absorbing devices 28 may be specially designed or may consist of standard pieces used in combination to fit this application. Energy absorbing devices 28 may be used in a variety of combinations such as independent double-wishbone with stabilizer bar or some other combination. Energy absorbing devices 28 utilized in this invention may be one or a combination of the following means for absorbing energy: compressed air spring, oil dampened, extensional coil spring, compressional coil spring, torsional spring, elastomer, gas charged, hydraulic gas charged with progressive valve technology, or other means. Energy absorbing devices 28 used in the footgear suspension device 100 may act either in compressional or extensional regime and are interchangeable by changing pivot positions. Energy absorbing devices 28 used in the footgear suspension device 100 may use pistons that are cylindrical or spherical or another shape. The pistons may be used to transfer forces through the energy absorbing device 28. The pistons may be used in conjunction with cylinders and may contain seals and/or adjustable apertures in order to create the most responsive and active suspension possible. Electronic sensors may be used in conjunction with recording devices, or transmitting and receiving devices to send electric impulses containing suspension data for full color graphical analysis by computer and trained technician, in order to make rapid energy absorbing device 28 adjustments in the foot gear suspension device 100 for optimal footgear suspension device 100 performance at any give time. As a ski racing technician tries to use the perfect wax on race day the technician may also try to find the optimal footgear suspension device 100 adjustments to enhance racer performance. Adjustments may be made for reasons of skier or skater weight, skier or skater velocity, temperature changes, changing surface contacting conditions. Energy absorbing devices 28 may be adjusted for a softer, smoother, more gentle overall footgear suspension device 100 feel. Footspension refers to the art of suspending the foot in the mechanical manner created by the footgear suspension device 100. Further, the forces that pass through the energy absorbing device 28 may be controlled by using combinations of swingarms 29, linkage swingarms 20, or other combinations of similar energy absorbing devices 28. The energy absorbing devices 28 may also utilize the footgear suspension device 100 chassis 25 as their body. The energy absorbing device 28 body casing may be cylindrical, conical, or another shape. By doing so, the footgear suspension device 100 may be fabricated as an integral piece of a ski 78 or skate and may reduce the necessity for a large number of pieces and other fabricated parts.

The arched underside 91 of the chassis 25 of the footgear suspension device 100 is a feature that enables the footgear suspension device 100 to have maximum ground clearance. The shape and size of swingarms 29 and linkage swingarms 20 enables the footgear suspension device 100 to have a minimum or maximum amount of travel. These features allow the footgear suspension device 100 to travel over many terrains. The concept of maximizing ground clearance may be used as a guideline to create the footgear suspension device 100 as an extension of the human foot and the human foot's skeletal arches.

Obviously, many modifications and variations of the present invention are possible in light of the above teachings. It is therefore to be understood that, within the scope of the appended claims, the invention may be practiced otherwise than as specifically described.

What is claimed and desired to be secured by letters patent of the United States is:

1. A footgear suspension device comprising:

a chassis having a front end, a rear end, and a topmost surface forming a footwear engaging portion providing an area for footwear attachment to the chassis, disposed between the front end of the chassis and the rear end of the chassis, at least one front end swingarm pivotably attached to the front end of the chassis, the swingarm extending from the front of the chassis, located forwardly of the footwear engaging portion and angling in a downward direction from the chassis, forward of the chassis and not under the chassis, at least one rear end swingarm pivotably attached to the rear end of the chassis, the swingarm extending from the rear of the chassis, located rearwardly of the footwear engaging portion and angling in a downward direction from the chassis, aft of the chassis and not under the chassis, a surface contacting means attached to the front end swingarm for engaging the surface over which the chassis moves, the attachment point to the surface contacting means on the swingarm being forward of and below the front end swingarm attachment to the chassis, a surface contacting means attached to the rear end swingarm for engaging the surface over which the chassis moves, the attachment point to the surface contacting means on the swingarm being rearward of and below the rear end swingarm attachment to the chassis, a means for energy damping attached to the swingarms for damping relative motion between the chassis and the surface contacting means whereby the surface contacting means length extends further fore and aft of the chassis by the movement of the swingarms, providing greater stability, balance and control to a user while absorbing shocks.

2. A footgear suspension device as in claim 1 wherein:

the surface contacting means are selected from the group comprising wheels, wheels having pneumatic tires, ice skate blades, skis, shoe soles, boot soles, skateboards, snowboards, and surfboards.

3. A footgear suspension device as in claim 1 wherein:

the means for energy damping are selected from the group comprising, springs, hydraulic pistons, compression washers, friction washers, elastomers, progressive valve dampers, oil dampers, adjustable dampers, air dampers, air springs, gas charged cylinders, and combinations thereof.

4. A footgear suspension device as in claim 1 wherein:

the means for energy damping is connected between the swingarm and the chassis.

5. A footgear suspension device as in claim 1 wherein:

the means for energy damping is connected between the front end swingarm and the rear end swingarm.

6. A footgear suspension device as in claim 1 wherein:

the surface contacting means are wheels, and brakes are connected to at least one wheel for decelerating.

7. A footgear suspension device as in claim 1 further in combination with footwear, the footwear being permanently attached to the chassis for securing the user's foot to the footgear suspension device.

8. A footgear suspension device as in claim 1 wherein: the chassis has bindings for engaging footwear, and the footwear engaging the bindings holds the user's foot to the footgear suspension device.

9. A footgear suspension device as in claim 8 wherein: the surface engaging means are wheels having axles, the axles having bearings.

10. A footgear suspension device as in claim 1 wherein:

the chassis has a bottom side, a skid plate is attached to the bottom side of the chassis to protect the chassis from impact with the surface over which the chassis is moving.

11. A footgear suspension device as in claim 10 wherein:

rollers are attached to the bottom side of the chassis to protect the chassis from impact with the surface over which the chassis is moving.

12. A footgear suspension device as in claim 10 wherein:

there is an energy absorbing means between the chassis and the skid plate for absorbing shocks.

13. A footgear suspension device as in claim 1 wherein:

the front swing arm and rear swing arm extend from the chassis as arms of a V-shape.

* * * * *